US006795377B2

(12) United States Patent
Gorden

(10) Patent No.: US 6,795,377 B2
(45) Date of Patent: Sep. 21, 2004

(54) PERSONALIZED ALARM CLOCK

(76) Inventor: Christopher J. Gorden, 25878 Milano La., Valencia, CA (US) 91355

( * ) Notice: Subject to any disclaimer, the term of this patent is extended or adjusted under 35 U.S.C. 154(b) by 78 days.

(21) Appl. No.: 10/127,497

(22) Filed: Apr. 23, 2002

(65) Prior Publication Data

US 2003/0198137 A1 Oct. 23, 2003

(51) Int. Cl.[7] ..... G04B 47/00
(52) U.S. Cl. ..... 368/12; 368/13; 368/10
(58) Field of Search ..... 368/10, 4, 231, 368/47, 281, 282, 41, 12; 455/556

(56) References Cited

U.S. PATENT DOCUMENTS

| | | | | | |
|---|---|---|---|---|---|
| 3,611,151 | A | | 10/1971 | Fernandez | 455/231 |
| D297,428 | S | | 8/1988 | McElroy | D14/72 |
| 5,248,568 | A | | 9/1993 | Getz | 368/73 |
| 5,373,488 | A | | 12/1994 | Lidor | 368/13 |
| 5,689,987 | A | * | 11/1997 | Yasui | 338/41 |
| 5,708,627 | A | * | 1/1998 | Gormley | 368/4 |
| 5,802,294 | A | * | 9/1998 | Ludwig et al. | 365/200 |
| 5,832,067 | A | | 11/1998 | Herold | 379/110.01 |
| 5,970,125 | A | | 10/1999 | Smith et al. | 379/93.25 |
| 5,995,455 | A | | 11/1999 | Kutosky | 368/73 |
| 6,009,048 | A | | 12/1999 | Raesz | 368/10 |
| 6,018,580 | A | | 1/2000 | Nellessen | 379/355 |
| D420,352 | S | | 2/2000 | Chan | D14/171 |
| 6,034,591 | A | | 3/2000 | Glynn et al. | 340/309.15 |
| 6,035,214 | A | * | 3/2000 | Henderson | 455/556 |
| 6,118,856 | A | | 9/2000 | Paarsmarkt et al. | 379/93.24 |
| D432,517 | S | | 10/2000 | Zeitman | D14/171 |
| 6,151,278 | A | | 11/2000 | Najarian | 368/12 |
| 6,158,884 | A | * | 12/2000 | Lebby et al. | 368/282 |
| 6,215,862 | B1 | | 4/2001 | Lopes | 379/110.01 |
| 6,236,621 | B1 | | 5/2001 | Schettino | 368/10 |
| 6,236,622 | B1 | | 5/2001 | Blackman | 368/10 |
| 6,238,061 | B1 | | 5/2001 | McKenzie et al. | 362/253 |
| 6,310,833 | B1 | | 10/2001 | Guyett et al. | 368/63 |
| D451,901 | S | | 12/2001 | Chan | D14/171 |
| D452,227 | S | | 12/2001 | Chan | D14/170 |
| 6,496,449 | B1 | * | 12/2002 | Armstrong | 368/231 |

FOREIGN PATENT DOCUMENTS

| | | |
|---|---|---|
| WO | WO 95/04426 | 2/1995 |

* cited by examiner

*Primary Examiner*—Randy W. Gibson
*Assistant Examiner*—Jeanne-Marguerite Goodwin
(74) *Attorney, Agent, or Firm*—Richard C. Litman

(57) ABSTRACT

A personalized alarm clock allows a user to receive a predetermined audio and/or image signal, or to place a predetermined telephone call to a selected telephone number at a predetermined time. The personalized alarm clock is generally configured in the form of a portable entertainment device, such as a portable AM/FM radio and/or CD/DVD device. The personalized alarm clock includes at least one input device, at least one output device, at least one input port, at least one output port, at least one telephone jack, an automatic telephone dialer, a central processing unit, at least one memory device, and a power supply. The personalized alarm clock is configured with upper and lower housings connected together by a hinge.

19 Claims, 4 Drawing Sheets

PERSONALIZED ALARM CLOCK

BACKGROUND OF THE INVENTION

1. Field of the Invention

The present invention relates generally to alarm clocks and, more particularly, to alarm clocks and like instrumentalities that activate a selected one of a variety of audible alarms at a selected time.

2. Description of the Related Art

Alarm clocks and like devices that activate an audible signal at a selected time and until the signal is stopped by activation of a switch are well known. Such alarms usually arouse a sleeping individual by the use of a buzzer or music from a device, such as an AM/FM radio or a CD player. However, many individuals who travel frequently have interest in receiving information about their temporary location, such as weather conditions, traffic conditions, etc. Alternatively, many individuals have a desire to speak to someone they know when they awake. Alarm clocks currently do not provide individuals with the ability to automatically place a telephone call to a remote location and receive information or hear a friendly voice.

The related art is represented by the following patents of interest.

U.S. Design Pat. No. 297,428, issued on Aug. 30, 1988 to Michael A. McElroy, shows an ornamental design for a combination telephone set and clock. McElroy does not suggest a personalized alarm clock according to the claimed invention.

U.S. Design Pat. No. 404,033, issued on Jan. 12, 1999 to Wai Hung Fong, shows an ornamental design for a digitalogue radio alarm clock. Fong does not suggest a personalized alarm clock according to the claimed invention.

U.S. Design Pat. No. 420,352, issued on Feb. 8, 2000 to Kui-Wai Chan, shows an ornamental design for a radio alarm clock. Chan '352 does not suggest a personalized alarm clock according to the claimed invention.

U.S. Design Pat. No. 432,517, issued on Oct. 24, 2000 to Josh Zeitman, shows an ornamental design for a radio alarm clock. Zeitman does not suggest a personalized alarm clock according to the claimed invention.

U.S. Design Pat. No. D451,901 S, issued on Dec. 11, 2001 to Chuk Shun Chan, shows an ornamental design for a radio alarm clock. Chan '901 does not suggest a personalized alarm clock according to the claimed invention.

U.S. Design Pat. No. D452,227 S, issued on Dec. 18, 2001 to Chuk Shun Chan, shows an ornamental design for an alarm clock with a radio. Chan '227 does not suggest a personalized alarm clock according to the claimed invention.

U.S. Pat. No. 3,611,151, issued on Oct. 5, 1971 to Jose L. Fernandez, describes a clock radio with a tape player. Fernandez does not suggest a personalized alarm clock according to the claimed invention.

U.S. Pat. No. 5,243,568, issued on Sep. 7, 1993 to Nancy Burch et al., describes an electronic circuit which utilizes a time-setting mechanism and an audio system of a clock/radio to cause both light and sound to start at low intensity and increase gradually together to full intensity. Burch et al. does not suggest a personalized alarm clock according to the claimed invention.

U.S. Pat. No. 5,373,488, issued on Dec. 13, 1994 to Rony Lidor, describes a telephone alarm clock. Lodor does not suggest a personalized alarm clock according to the claimed invention.

U.S. Pat. No. 5,832,067, issued on Nov. 3, 1993 to John P. Herold, describes a method and apparatus for integrating telephone signals with an alarm clock. Herold does not suggest a personalized alarm clock according to the claimed invention.

U.S. Pat. No. 5,970,125, issued on Oct. 19, 1993 to Anthony H. Smith et al., describes a system and method for providing for providing messaging services at customer premises equipment. Smith et al. does not suggest a personalized alarm clock according to the claimed invention.

U.S. Pat. No. 5,995,455, issued on Nov. 30, 1999 to Thomas H. Kutosky, describes an alarm timer device. Kutosky does not suggest a personalized alarm clock according to the claimed invention.

U.S. Pat. No. 6,009,048, issued on Dec. 28, 1999 to Carole H. Raesz, describes a novelty radio-alarm clock. Raesz does not suggest a personalized alarm clock according to the claimed invention.

U.S. Pat. No. 6,018,580, issued on Jan. 25, 2000 to Leonard J. Nellessen, the contents of which are hereby incorporated by reference, describes a non-volatile automatic telephone dialer circuit. Nellessen does not suggest a personalized alarm clock according to the claimed invention.

U.S. Pat. No. 6,034,591, issued on Mar. 7, 2000 to Alex P. Glynn et al., describes an alarm clock device which programmably and automatically coordinates the movement of one or more electric toy trains. Glynn et al. does not suggest a personalized alarm clock according to the claimed invention.

U.S. Pat. No. 6,118,856, issued on Sep. 12, 2000 to James B. Paarsmarkt et al., describes a method and apparatus for automatically forwarding an email message or portion thereof to a remote device. Paarmarkt et al. does not suggest a personalized alarm clock according to the claimed invention.

U.S. Pat. No. 6,151,278, issued on Nov. 21, 2000 to David Najarian, describes a remote device for silent awakening. Najarian does not suggest a personalized alarm clock according to the claimed invention.

U.S. Pat. No. 6,215,862 B1, issued on Apr. 10, 2001 to Robert L. Lopes, describes a telephone that operates as a time server for synchronizing an appliance or peripheral by accessing a time service over telephone lines to obtain an accurate geographic time for the telephone, and by transmitting a synchronizing pulse to the appliance at a predetermined time to set the time function of the appliance. Lopes does not suggest a personalized alarm clock according to the claimed invention.

U.S. Pat. No. 6,236,621 B1, issued on May 22, 2001 to Cecilia C. Schettino, describes a pillow alarm device. Schettino does not suggest a personalized alarm clock according to the claimed invention.

U.S. Pat. No. 6,238,061 B1, issued on May 29, 2001 to Roy L. McKenzie et al., describes a self-contained, portable, remote controlled, combination television receiver, AM/FM radio receiver, clock, and electric lamp. McKenzie et al. does not suggest a personalized alarm clock according to the claimed invention.

U.S. Pat. No. 6,310,833 B1, issued on Oct. 30, 2001 to Thomas G. Guyett et al., describes an interactive voice recognition and speech synthesis clock radio. Guyett et al. does not suggest a personalized alarm clock according to the claimed invention.

International Patent document WO 95/04426, published on Feb. 9, 1995, describes an information distribution system. International '426 does not suggest a personalized alarm clock according to the claimed invention.

None of the above inventions and patents, taken either singularly or in combination, is seen to describe the instant invention as claimed.

SUMMARY OF THE INVENTION

A personalized alarm clock is provided that allows a user to receive a predetermined audio and/or image signal, or to place a predetermined telephone call to a selected telephone number at a predetermined time. The personalized alarm clock is generally configured in the form of a portable entertainment device, such as a portable AM/FM radio and/or CD/DVD device.

The personalized alarm clock includes at least one input device, at least one output device, at least one input port, at least one output port, at least one telephone jack, an automatic telephone dialer, a central processing unit (CPU), at least one memory device, and a power supply. The personalized alarm clock is configured with upper and lower housings connected together by a hinge.

The upper housing may contain therein a video output device that may be any well known type of device, such as a liquid crystal display (LCD), an organic LCD, a light emitting diode (LED) display, an organic LED display (OLED), a thin film transistor display, or the like. The video output device may also be a touch sensitive screen. The video output device displays time in either analog or digital form. Alternatively, the video output device may display any visual image received from a DVD, a digital memory, or received externally. The upper housing may also include an audio output device, such as at least one speaker or the like, that is driven by at least one amplifier. The upper housing may also include function keys or buttons, and a microphone.

The lower housing may contain therein clock circuitry and an automatic telephone dialer. The lower housing may also include function keys or buttons, an AM/FM radio receiver, a CD/DVD device, a transceiver, a modem, input/output ports, etc. The personalized alarm clock is configured to operate on regulated DC power, and includes a power source, such as a battery or the like. An input power port may be included to provide a port for connecting the personalized alarm clock to an external power source, such as utility AC power or the like that has been transformed to DC power through an AC adapter. These elements may be of any type will known in the art. For example, the modem may be a cellular capable modem, a softmodem, a chip modem, a wireless modem, or the like. The modem enables the personalized alarm clock to connect to the Internet for the purpose of receiving broadcast audio and/or image data over a telephone network, such as a wireless cellular system or the like.

The AM/FM receiver may be any well known AM/FM radio receiver that receives radio communication via radio frequency waves. The CD/DVD device may be any well known CD/DVD device that plays and/or reads data from a CD or a DVD.

The transceiver is of a type well known in the art, and is preferably constructed of miniaturized solid state components that permit the assembly of these components into a transceiver small enough in size to be removably received in the upper or lower housing of the personalized alarm clock. The transceiver can establish a two-way wireless communication link between the personalized alarm clock and a telephone line by way of the antenna.

The automatic telephone dialer is of a type well known in the art, and is preferably constructed of miniaturized solid state components that permit the assembly of these components onto a printed circuit board. The automatic telephone dialer may be configured to operate by power from current supplied through a standard telephone line rather than by batteries or an AC adapter. Alternatively, batteries, utility power or the like can be used. The personalized alarm clock may include two telephone jacks configured to connect the alarm clock to a remote telephone jack via a telephone cord. As such, a user can receive and make telephone calls with the remote telephone. Alternatively, the alarm clock may be configured to establish two-way communication through the combined use of a microphone and speakers on the alarm clock, and through one telephone cord connecting the alarm clock to a telephone jack.

The input/output ports may include a video port, an S-video port, an audio port, a serial port, a parallel port, a universal serial bus port, a firewire port, an infrared port, a radio frequency port, or the like.

Major known electrical components are mounted within the upper and lower housings of the personalized alarm clock. Such components typically include a printed circuit board mounted in firm support within, for example, the lower housing. The circuit board carries certain coupling and driver electronics with the CPU and the at least one memory device, such as a read-only memory (ROM) and a random access memory (RAM). In general, ROM is used to contain instructions and programs while RAM is employed for operating and working data. The memory devices may also include a floppy disk, hard disk, CD, DVD, MD, tape, flash memory, a memory stick, a removable memory device, etc. The memory devices may be removable or non-removable by the user.

The memory devices can contain audio and/or image data, such as audio music that has been stored in, for example, the MP3 format using appropriate software that manages recording and playback of digital audio content. The memory devices can also contain image data such as video, graphic, animation, and/or photographic stored in, for example, the MPEG, JPEG, HTML, BNP formats, or the like. Of course, movement and process of instructions as well as data is controlled and accomplished by the CPU. The CPU is connected to all the function keys or buttons on the upper and lower housings and is variously connected to the other elements of the personalized alarm clock. The memory devices are connected to the CPU through several signal paths. In addition, as is well known in the art, a power source is provided wherein the personalized alarm clock may be powered from batteries (rechargeable or non-rechargeable) or an alternating current source, so as to conserve and/or charge the batteries as well known in prior portable entertainment devices.

Software embedded in the personalized alarm clock includes an operating system and application programs to perform receive, read, and output functions of audio and/or image data coming into and stored on the personalized alarm clock. A software communications program may be provided to interface with a remote device that provides audio and/or image data via the modem. Voice quality telephone transmission may be used to communicate audio and/or image data from a remote device to the personalized alarm clock. Alternatively, other techniques can be employed including cellular, short wave, wireless, radio frequency, etc. The microphone may be used for inputting audio data or for supplementing a speaker while effecting a telephone conversation.

Telephone numbers may be programmed into the personalized alarm clock. For example, the RAM may have memories for respectively storing name data and telephone number data. Each of the memories may have a name data storage area for storing name data and a number data storage including digit memories for storing telephone number data. The RAM may also have an address designation register for designating an address of one of the memories and a digit designation register for designating one of the digit memories.

The personalized alarm clock preferably includes a plurality of function keys or buttons. For example, the personalized alarm clock may include a mode key, an on/off key, a volume key, a set key, an alarm key, an hour key, a minute key, an AM/FM key, a program key, a store key, a CD key, a DVD key, a stop key, a play key, a snooze key, and an alphanumeric key pad. The function keys or buttons may be translucent and include illumination devices underneath to illuminate predetermined keys in the dark. The function keys or button may be depressed, rocked, or activated for setting the time of the clock, the alarm time on the clock, an increase of the alarm or time set, and a decrease of the alarm or time set as indicated.

Each key may have a typical alphanumeric or operational notation on its top or tactile surface. Each key may be coded by color, shape or other graphic symbol, and may also be coded by texture. The keys are preferably of the type requiring mechanical movement for activation. Mechanically actuated keys preferably have a depression stroke of at least one millimeter, and preferably two to five millimeters. In addition, the keys preferably have tactile feedback, as known in the art. Audible feedback may also be provided, either through a mechanical feedback mechanism associated with the key structure or a separate electronic mechanism in the personalized alarm clock. It is possible to include a touch sensitive surface to the personalized alarm clock. A touch sensitive surface may be superimposed on the surface of either the upper or lower housing.

The mode key switches the personalized alarm clock from one mode to another, such as from the clock to the AM/FM radio, the CD/DVD, etc. The on/off key switches the device designated by the mode key on and off. The volume key adjusts the volume of the output devices. The set key allows the user to set a parameter of the designated mode switch device, such as setting the time of the clock, a radio frequency of the AM/FM radio, a track of the CD/DVD, etc. The alarm key switches the alarm setting on and off. The hour key sets an hour time. The minute key sets a minute time. The AM/FM key switches between AM and FM. The program key allows the user to enter program data, such as telephone numbers, CD/DVD tracks, etc. The store key allows the user to store program data. The CD key allows the user to select a CD track. The DVD key allows the user to select a DVD track. The stop key allows the user to stop the function of the device designated by the mode key. The play key allows the user to turn off an active alarm and have it reactivate after a predetermined period of time. The snooze key allows the user to turn off an active alarm and have it reactivate after a predetermined period of time. The alphanumeric keypad is preferably configured in the form of a conventional telephone keypad and allows the user to enter in a telephone number for storage or for dialing.

The user may select and set a time and designate a particular alarm. Such an alarm may be a buzzer with a predetermined loudness, a predetermined radio station, a predetermined CD/DVD track, etc. The alarm may also be configured to activate the telephone dialer to dial a predetermined telephone number, such as a local weather station. The CPU will then read out data from the memory devices in accordance with a program stored in the memory devices, and send numerical value data to the telephone dialer. The telephone dialer will then switch the telephone line off-hook and dial the designated telephone number. If the dialed telephone number receives no answer or a busy signal after a predetermined number of rings designated by the user, the telephone dialer may disconnect and go on-hook for a predetermined period of time designated by the user, and may then redial the designated telephone number after the designated predetermined period of time expires. Alternatively, the telephone dialer may go on-hook for a predetermined period of time designated by the user, and may then go off-hook and dial a sequential predetermined alternative telephone number. In this case, if the dialed telephone number receives no answer or a busy signal after a predetermined number of rings designated by the user, the telephone dialer may disconnect and go on-hook for the designated predetermined period of time, and may then go off-hook and dial another sequential predetermined alternative telephone number. Furthermore, if the telephone line is not active due to weather conditions or the like, the user may program the personalized alarm clock to turn on a radio station, a CD/DVD track, a preprogrammed audio recording, or the like, as designated by the user.

Once a dialed telephone number is answered, the personalized alarm clock may remain on-hook until the user deactivates the telephone call, such as deactivating the call after listening to a recorded weather report. Alternatively, the user may preconfigure the personalized alarm clock to effect a two-way telephone call by activating a microphone in the alarm clock. The user can then carry on a hands-free telephone call with, for example, a friend or relative or the like. When in-use, the display device displays both the image of the party captured by a camera of a remote video telephone on an opposite end of an established communication channel and an image captured by the camera of the personalized alarm clock. Thus, a user using the personalized alarm clock can view both the party to which they are communicating and themselves during a transmission.

Accordingly, it is a principal aspect of the invention to provide a personalized alarm clock that allows a user to receive a predetermined audio and/or image signal, or to place a predetermined telephone call to a selected telephone number at a predetermined time.

It is another aspect of the invention to provide a personalized alarm clock that allows a user to activate any of a variety of predetermined alternative designated alarms on the basis of telephone call results.

It is an aspect of the invention to provide improved elements and arrangements thereof in a personalized alarm clock for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
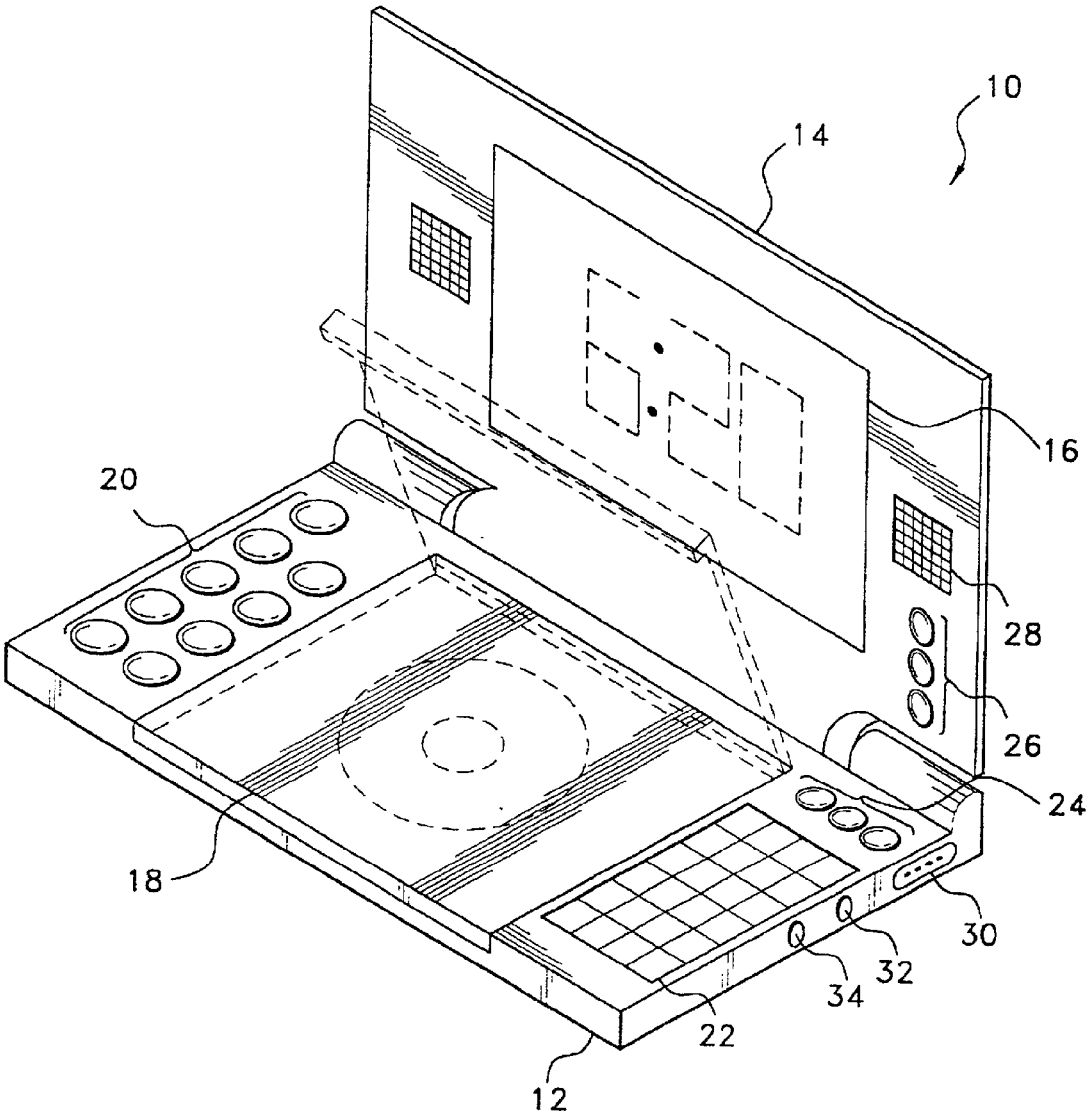
FIG. 1 is a front, perspective view of a personalized alarm clock according to the present invention.

This invention relates to a personalized alarm clock. The invention disclosed herein is, of course, susceptible of embodiment in many different forms. Shown in the drawings and described hereinbelow in detail is a preferred embodiment of the invention. It is to be understood, however, that the present disclosure is an exemplification of the principles of the invention and does not limit the invention to the illustrated embodiment.

Figure 2:
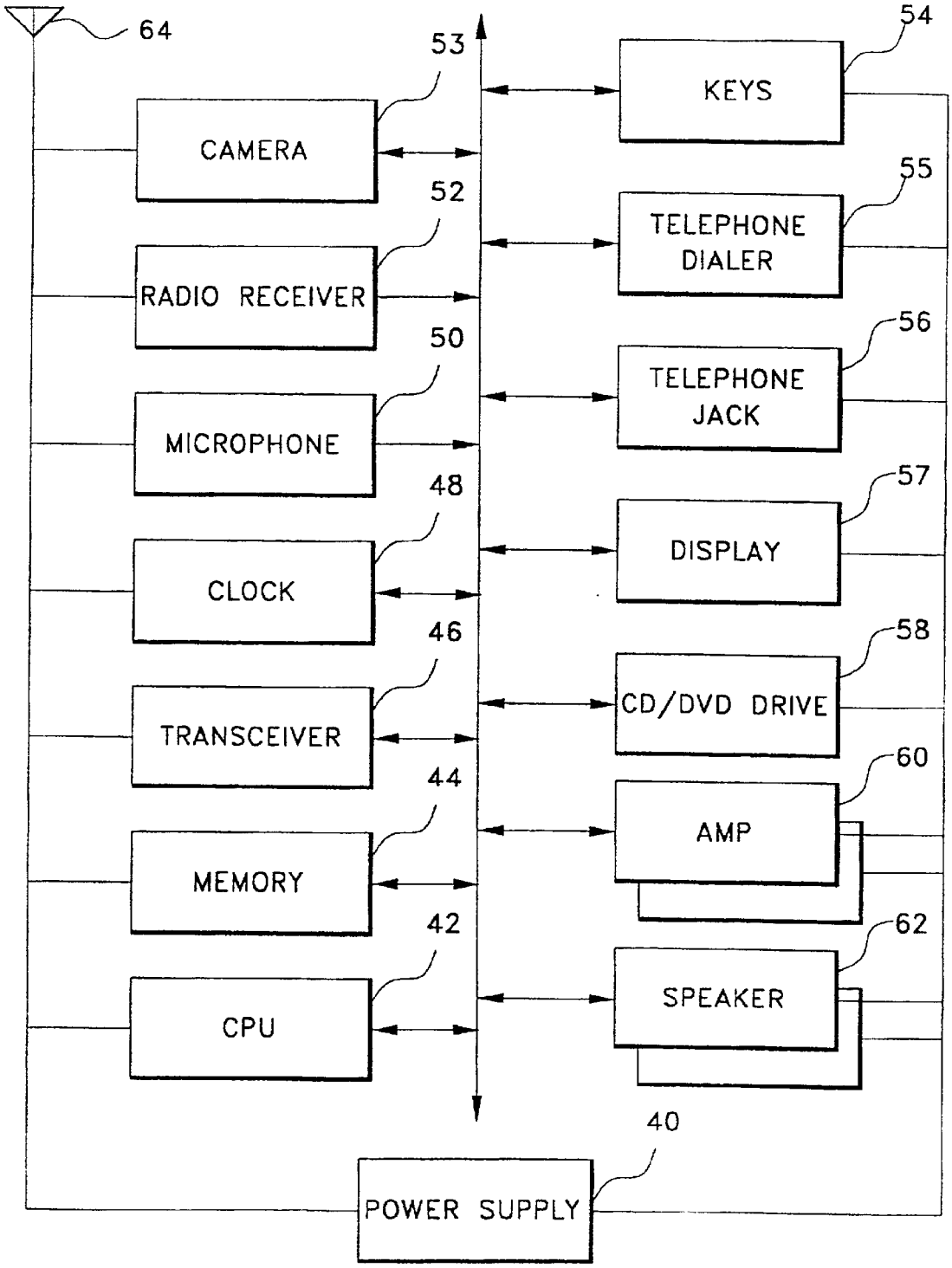
FIG. 2 is a block diagram of a personalized alarm clock according to the present invention.

As illustrated in FIGS. 1 and 2, a personalized alarm clock 10 is provided that allows a user to receive a predetermined audio and/or image signal, or to place a predetermined telephone call to a selected telephone number at a predetermined time. The personalized alarm clock 10 is generally configured in the form of a portable entertainment device, such as a portable AM/FM radio and/or CD/DVD device.

The personalized alarm clock 10 includes at least one input device, at least one output device, at least one input port, at least one output port, at least one telephone jack, an automatic telephone dialer, a CPU, at least one memory device, and a power supply. The personalized alarm clock 10 is configured with upper and lower housings 14, 12 connected together by a hinge.

The upper housing 14 may contain therein a video output device 16 that may be any well known type of device, such as an LCD, an organic LCD, an LED display, an organic LED display (OLED), a thin film transistor display, or the like. The video output device may also be a touch sensitive screen ("touch screen"). With a touch screen, a user can select from options displayed on the touch screen's viewing surface by touching the surface adjacent the desired option or, in some designs, by touching the option directly. The video output device 16 displays time in either analog or digital form. Alternatively, the video output device 16 may display any visual image received from a DVD, a digital memory, or received externally. The upper housing 14 may also include an audio output device 28, such as at least one speaker or the like, that is driven by at least one amplifier. The upper housing 14 may also include function keys or buttons 26, a microphone 50, and a camera 53. The camera 53 is preferably a digital camera which, upon capturing an image, converts the captured image into a digital bit stream for storage or transmission.

The lower housing 12 may contain therein clock circuitry and an automatic telephone dialer. The lower housing 12 may also include function keys or buttons 20, 22, an AM/FM radio receiver 52, a CD/DVD device 18, a transceiver 46, a modem 30, and input/output ports 32, 34, etc. The personalized alarm clock 10 is configured to operate on regulated DC power, and includes a power supply 40, such as batteries or the like. An input power port may be included to provide a port for connecting the personalized alarm clock to an external power source, such as utility AC power or the like that has been transformed to DC power through an AC adapter. These elements may be of any type will known in the art. For example, the modem 30 may be a cellular capable modem, a softmodem, a chip modem, a wireless modem, or the like. The modem enables the personalized alarm clock 10 to connect to the Internet for the purpose of receiving broadcast audio and/or image data over a telephone network, such as a wireless cellular system or the like.

The AM/FM receiver 52 may be any well known AM/FM radio receiver that receives radio communication via radio frequency waves. The CD/DVD device 58 may be any well known CD/DVD device that plays and/or reads data from a CD or a DVD.

The transceiver 46 is of a type well known in the art, and is preferably constructed of miniaturized solid state components that permit the assembly of these components into a transceiver small enough in size to be removably received in the upper or lower housing 14, 12 of the personalized alarm clock 10. The transceiver 46 can establish a two-way wireless communication link between the personalized alarm clock and a telephone line by way of the antenna.

The automatic telephone dialer 55 is of a type well known in the art, and is preferably constructed of miniaturized solid state components that permit the assembly of these components onto a printed circuit board. The automatic telephone dialer 55 may be configured to operate by power from current supplied through a standard telephone line rather than by batteries or an AC adapter. Alternatively, batteries, utility power or the like can be used. The personalized alarm clock 10 may include two telephone jacks 56 configured to connect the alarm clock 10 to a remote telephone jack via a telephone cord. As such, a user can receive and make telephone calls with the remote telephone. Alternatively, the alarm clock 10 may be configured to establish two-way communication through the combined use of a microphone 50 and speakers 62 on the alarm clock, and through one telephone cord connecting the alarm clock to a telephone jack.

The input/output ports 30, 32 may include a video port, an S-video port, an audio port, a serial port, a parallel port, a universal serial bus port, a firewire port, an infrared port, a radio frequency port, or the like. A universal serial bus port is a new type of port and operates with data communication protocol that permits a plurality of newly designed peripheral devices to be connected to the personalized alarm clock in a daisy chain configuration. A firewire port is an audio/video digital interface according to the Institute of Electrical and Electronics Engineers 1394 standard. The other types of ports are well known to one skilled in the art.

Major known electrical components are mounted within the upper and lower housings 14, 12 of the personalized alarm clock 10. Such components typically include a printed circuit board mounted in firm support within, for example, the lower housing. The circuit board carries certain coupling and driver electronics with the CPU 42 and at least one memory device 44, such as ROM and RAM. In general, ROM is used to contain instructions and programs while RAM is employed for operating and working data. The memory devices may also include a floppy disk, hard disk, CD, DVD, MD, tape, flash memory, a memory stick, a removable memory device, etc. The memory devices may be removable or non-removable by the user.

The memory devices 44 can contain audio and/or image data, such as audio music that has been stored in, for example, the MP3 format using appropriate software that manages recording and playback of digital audio content. The memory devices 44 can also contain image data such as video, graphic, animation, and/or photographic stored in, for example, the MPEG, JPEG, HTML, BNP formats, or the like. Of course, movement and process of instructions as well as data is controlled and accomplished by the CPU 42. The CPU 42 is connected to all the function keys or buttons 20, 22, 26 on the upper and lower housings 14, 12 and is variously connected to the other elements of the personalized alarm clock 10. The memory devices 44 are connected to the CPU through several signal paths. In addition, as is well known in the art, a power supply is provided wherein the personalized alarm clock may be powered from batteries (rechargeable or non-rechargeable) or an alternating current source, so as to conserve and/or charge the batteries as well known in prior portable entertainment devices.

Software embedded in the personalized alarm clock includes an operating system and application programs to perform receive, read, and output functions of audio and/or image data coming into and stored on the personalized alarm clock. A software communications program may be provided to interface with a remote device that provides audio and/or image data via the modem. Voice quality telephone transmission may be used to communicate audio and/or image data from a remote device to the personalized alarm clock 10. Alternatively, other techniques can be employed including cellular, short wave, wireless, radio frequency, etc. The microphone 50 may be used for inputting audio data or for supplementing a speaker while effecting a telephone conversation.

Telephone numbers may be programmed into the personalized alarm clock 10. For example, the RAM may have memories for respectively storing name data and telephone number data. Each of the memories 44 may have a name data storage area for storing name data and a number data storage including digit memories for storing telephone number data. The RAM may also have an address designation register for designating an address of one of the memories and a digit designation register for designating one of the digit memories.

The personalized alarm clock 10 preferably includes a plurality of function keys or buttons 20, 22, 26. For example, the personalized alarm clock 10 may include a mode key, an on/off key, a volume key, a set key, an alarm key, an hour key, a minute key, an AM/FM key, a program key, a store key, a CD key, a DVD key, a stop key, a play key, a snooze key, and an alphanumeric key pad. The function keys or buttons 20, 22, 26 may be translucent and include illumination devices underneath to illuminate predetermined keys in the dark. The function keys or button 20, 22, 26 may be depressed, rocked, or activated for setting the time of the clock, the alarm time on the alarm clock 10, an increase of the alarm or time set, and a decrease of the alarm or time set as indicated.

Each key may have a typical alphanumeric or operational notation on its top or tactile surface. Each key may be coded by color, shape or other graphic symbol, and may also be coded by texture. The keys are preferably of the type requiring mechanical movement for activation. Mechanically actuated keys preferably have a depression stroke of at least one millimeter, and preferably two to five millimeters. In addition, the keys preferably have tactile feedback, as known in the art. Audible feedback may also be provided, either through a mechanical feedback mechanism associated with the key structure or a separate electronic mechanism in the personalized alarm clock 10. It is possible to include a touch sensitive surface to the personalized alarm clock 10. A touch sensitive surface may be superimposed on the surface of either the upper or lower housing 14,12.

The mode key switches the personalized alarm clock 10 from one mode to another, such as from the clock to the AM/FM radio, the CD/DVD, etc. The on/off key switches the device designated by the mode key on and off. The volume key adjusts the volume of the output devices. The set key allows the user to set a parameter of the designated mode switch device, such as setting the time of the clock, a radio frequency of the AM/FM radio, a track of the CD/DVD, etc. The alarm key switches the alarm setting on and off. The hour key sets an hour time. The minute key sets a minute time. The AM/FM key switches between AM and FM. The program key allows the user to enter program data, such as telephone numbers, CD/DVD tracks, etc. The store key allows the user to store program data. The CD key allows the user to select a CD track. The DVD key allows the user to select a DVD track. The stop key allows the user to stop the function of the device designated by the mode key. The play key allows the user to turn off an active alarm and have it reactivate after a predetermined period of time. The snooze key allows the user to turn off an active alarm and have it reactivate after a predetermined period of time designated by the user. The alphanumeric keypad is preferably configured in the form of a conventional telephone keypad and allows the user to enter in a telephone number for storage or for dialing.

The user may select and set a time and designate a particular alarm. Such an alarm may be a buzzer with a predetermined loudness, a predetermined radio station, a predetermined CD/DVD telephone dialer to dial a predetermined telephone number, such as a local weather station. The CPU 42 will then read out data from the memory devices 44 in accordance with a program stored in the memory devices 44, and send numerical value data to the telephone dialer 55. The telephone dialer 55 will then switch the telephone line off-hook and dial the designated telephone number. If the dialed telephone number receives no answer or a busy signal after a predetermined number of rings designated by the user, the telephone dialer may disconnect and go on-hook for a predetermined period of time designated by the user, and may then redial the designated telephone number after the designated predetermined period of time expires. Alternatively, the telephone dialer may go on-hook for a predetermined period of time designated by the user, and may then go off-hook and dial a sequential predetermined alternative telephone number. In this case, if the dialed telephone number receives no answer or a busy signal after a predetermined number of rings designated by the user, the telephone dialer may disconnect and go on-hook for the designated predetermined period of time, and may then go off-hook and dial another sequential predetermined alternative telephone number. Furthermore, if the telephone line is not active due to weather conditions or the like, the user may program the personalized alarm clock to turn on a radio station, a CD/DVD track, a preprogrammed audio recording, or the like, as designated by the user.

Once a dialed telephone number is answered, the personalized alarm clock may remain on-hook until the user deactivates the telephone call, such as deactivating the call after listening to a recorded weather report. Alternatively, the user may preconfigure the personalized alarm clock to effect a two-way telephone call by activating a microphone 50 in the alarm clock 10. The user can then carry on a hands-free telephone call with, for example, a friend or relative or the like. When in-use, the display device 57 displays both the image of the party captured by a camera of a remote video telephone (not shown) on an opposite end of an established communication channel and an image captured by the camera 53 of the personalized alarm clock 10. Thus, a user using the personalized alarm clock can view both the party to which they are communicating and themselves during a transmission.

Figure 3:
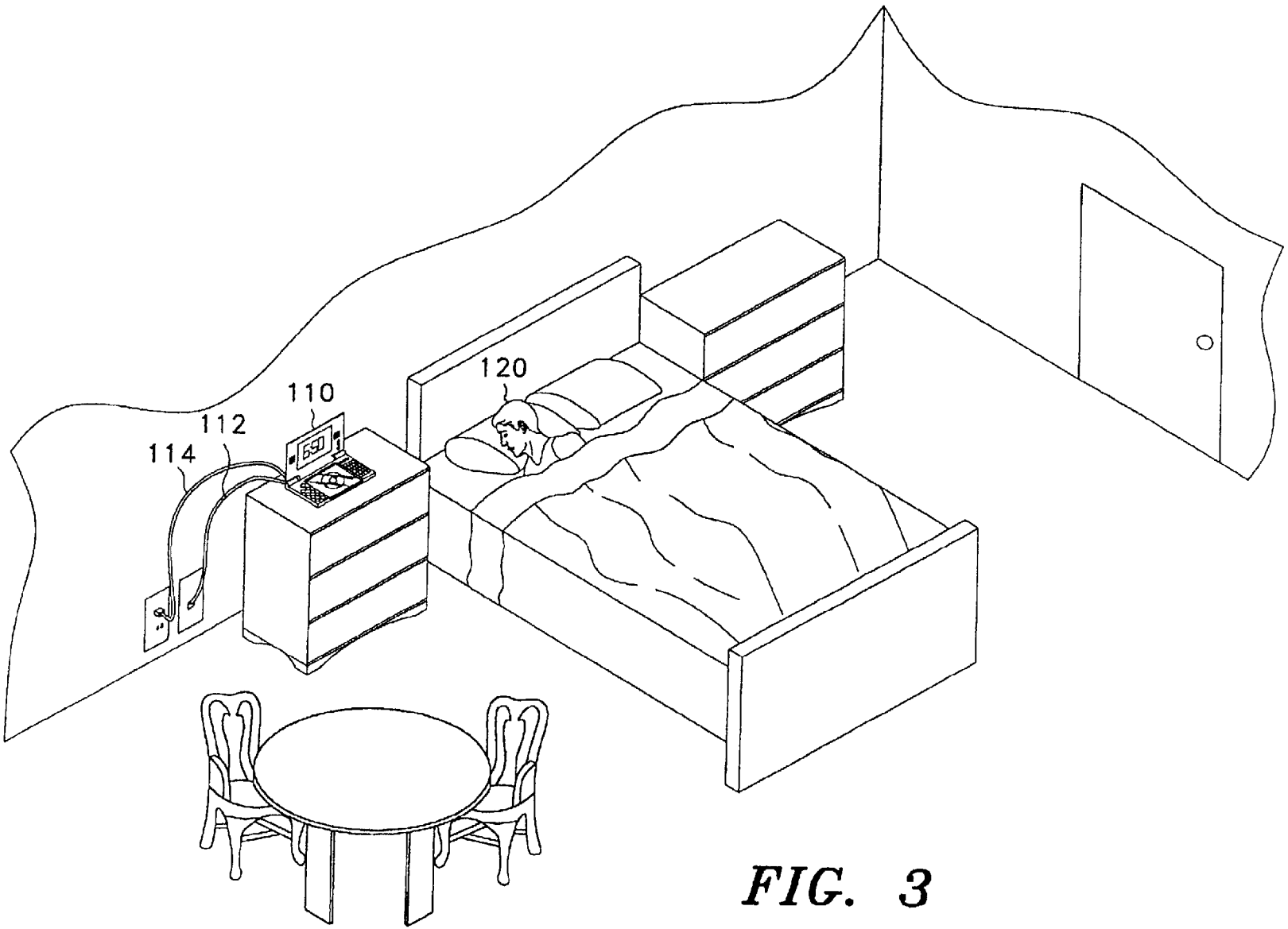
FIG. 3 is an environmental, front perspective view of a personalized alarm clock connected to a telephone jack.

FIG. 3 illustrates an environmental, front perspective view of a personalized alarm clock 110 and an individual 120 in a room, such as a hotel/motel room. The personalized alarm clock 110 is connected to a telephone jack by a telephone cord 112 and is connected to a utility power source through a wall terminal by a power cord 114. The personalized alarm clock 110 is configured to effect a two-way telephone call by activating a microphone in the alarm clock. The personalized alarm clock 110 may include a camera to enable the individual 120 to view both the party to which they are communicating and themselves during a transmission.

Figure 4:
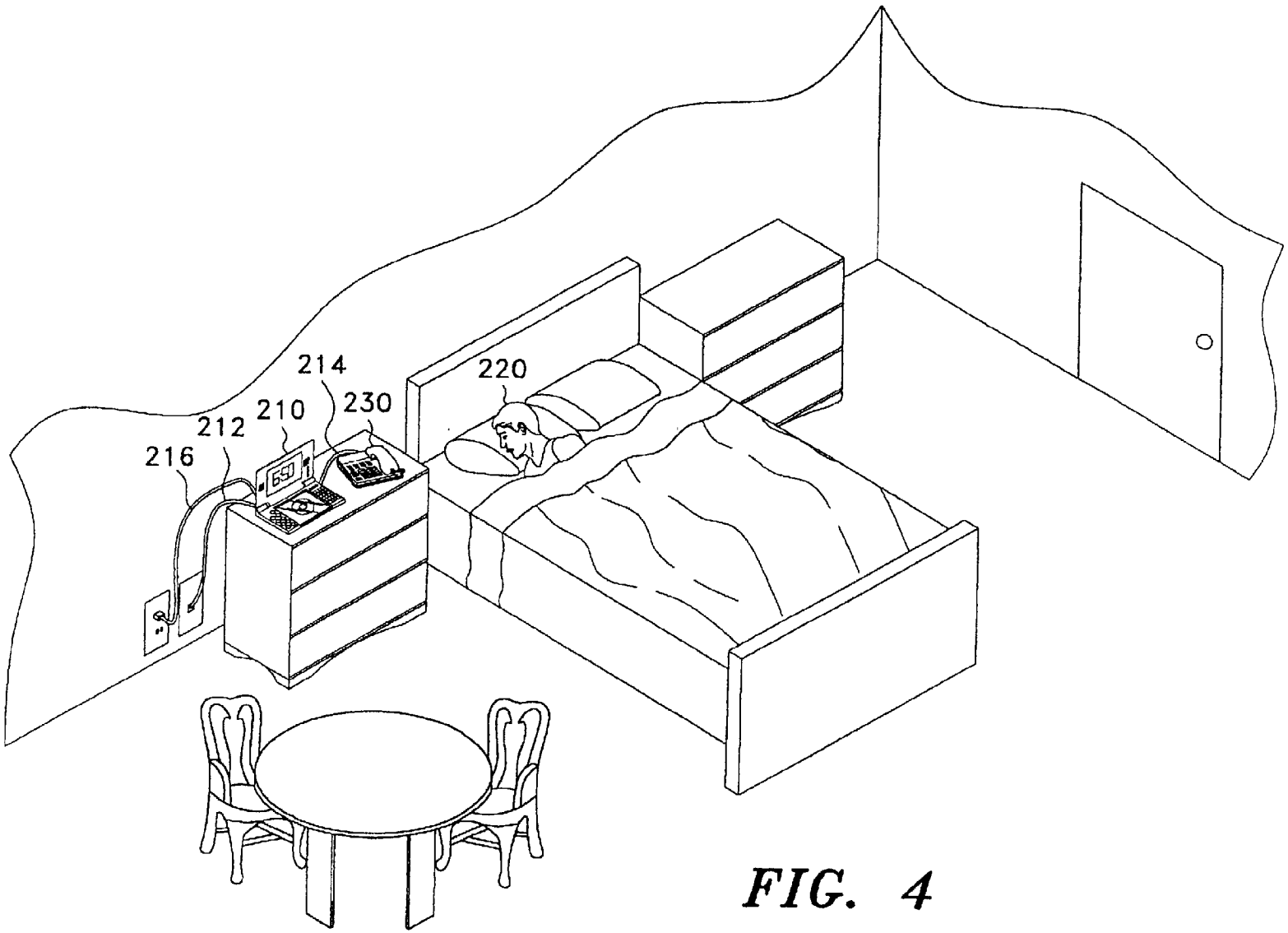
FIG. 4 is an environmental, front perspective view of a personalized alarm clock connected to a telephone jack and connected to a remote telephone.

FIG. 4 illustrates an environmental, front perspective view of a personalized alarm clock 210 and an individual 220 in a room, such as a hotel/motel room. The personalized alarm clock 110 is connected to a telephone jack by a telephone cord 212, is connected to a remote telephone 230 by a telephone cord 214, and is connected to a utility power source through a wall terminal by a power cord 216. The personalized alarm clock 210 is configured to allow the individual 220 to use a remote telephone 230 in conjunction with the alarm clock 210.

While the invention has been described with reference to a preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A personalized alarm clock comprising:

at least one input device;

at least one output device;

at least one input port;

at least one output port;

at least one telephone jack;

an automatic telephone dialer configured to automatically place a telephone call to a predetermined telephone number at a predetermined time;

a central processing unit interconnected to the at least one input device, the at least one output device, the at least one input port, the at least one output port, the at least one telephone jack, and the automatic telephone dialer;

at least one memory device interconnected to the central processing unit; and a power supply interconnected to the at least one input device, the at least one output device, the at least one input port, the at least one output port, the at least one telephone jack, the automatic telephone dialer, and the least one memory device.

2. The personalized alarm clock according to claim 1, wherein the personalized alarm clock is configured with upper and lower housings connected together by a hinge.

3. The personalized alarm clock according to claim 2, wherein the lower housing includes the at least one input port, the at least one output port, the at least one telephone jack, the automatic telephone dialer, clock circuitry, an automatic telephone dialer, a plurality of function keys, a radio receiver, a CD/DVD device, a transceiver, a modem, and an antenna.

4. The personalized alarm clock according to claim 3, wherein the modem is a cellular capable modem, a softmodem, a chip modem, or a wireless modem.

5. The personalized alarm clock according to claim 4, wherein the modem is configured to connect said personalized alarm clock to the Internet for the purpose of receiving broadcast audio data, image data, or both broadcast audio data and image data.

6. The personalized alarm clock according to claim 3, wherein the transceiver is configured of miniaturized solid state components that permit assembly of these components into a transceiver configured to be removably received in the upper or lower housing of said personalized alarm clock, and is configured to establish a two-way wireless communications link between said personalized alarm clock and a telephone line by way of the antenna.

7. The personalized alarm clock according to claim 3, wherein the automatic telephone dialer is configured of miniaturized solid state components that permit assembly of these components onto a printed circuit board, and is configured to operate by power from current supplied through a standard telephone line.

8. The personalized alarm clock according to claim 3, wherein the automatic telephone dialer is configured of miniaturized solid state components that permit assembly of these components onto a printed circuit board, and is configured to operate by power from a battery or utility power through an AC adapter.

9. The personalized alarm clock according to claim 3, wherein the personalized alarm clock includes one telephone jack, microphone, and a speaker, and is configured to establish two-way communication through combined use of the microphone and the speaker on the alarm clock, and through one telephone cord connecting the alarm clock to the telephone jack.

10. The personalized alarm clock according to claim 3, wherein the personalized telephone jack includes two telephone jacks configured to connect the personalized alarm clock to a remote telephone and to connect the personalized alarm clock to a remote telephone jack via a telephone cord.

11. The personalized alarm clock according to claim 1, wherein the upper housing includes a video output device, an audio output device, a plurality of function keys, a microphone, and a camera.

12. The personalized, alarm clock according to claim 11, wherein the video output device is selected from the group consisting of a liquid crystal display (LCD), an organic LCD, a light emitting diode (LED) display, an organic LED display, and a thin film transistor display.

13. The personalized alarm clock according to claim 11, wherein the audio output device is at least one speaker driven by at least one amplifier.

14. The personalized alarm clock according to claim 11, wherein the plurality of function keys includes a mode key configured to switch the personalized alarm clock from one mode to another, an on/off key configured to switch a device designated by the mode key on and off, a volume key configured to adjust the volume of the output devices, a set key configured to allow to set a parameter of the designated mode switch device, an alarm key configured to switch an alarm setting on and off, an hour key configured to set an hour time, a minute key configured to set a minute time, an AM/FM key configured to switch between AM and FM, a program key configured to enter program data, a store key configured to store program data, a CD key configured to select a CD track, a DVD key configured to select a DVD track, a stop key configured to stop a function of a device designated by the mode key, a play key configured play a device designated by the mode key, and a snooze key configured to turn off an active alarm and have the alarm reactivate after a predetermined period of time.

15. The personalized alarm clock according to claim 1, wherein said at least one memory device includes a read-only memory and a random access memory.

16. The personalized alarm clock according to claim 1, wherein said at least one memory device includes a floppy disk, a hard disk, a CD, a DVD, an MD, a tape, flash memory, or a memory stick.

17. The personalized alarm clock according to claim 1, where said at least one memory device is removable from said personalized alarm clock.

18. The personalized alarm clock according to claim 1, wherein said at least one memory device is configured to store audio data and image data.

19. The personalized alarm clock according to claim 1, wherein said audio data is audio music in MP3 format.

* * * * *